US006519952B2

(12) United States Patent
Kucharczyk

(10) Patent No.: US 6,519,952 B2
(45) Date of Patent: Feb. 18, 2003

(54) CRYOSTAT

(75) Inventor: Damian Kucharczyk, Wroclaw (PL)

(73) Assignee: Oxford Diffraction LTD, Oxfordshire (GB)

( * ) Notice: Subject to any disclaimer, the term of this patent is extended or adjusted under 35 U.S.C. 154(b) by 0 days.

(21) Appl. No.: 09/934,996

(22) Filed: Aug. 21, 2001

(65) Prior Publication Data

US 2002/0069651 A1 Jun. 13, 2002

(30) Foreign Application Priority Data

Aug. 22, 2000 (GB) ..... 0020709

(51) Int. Cl.[7] ..... F17C 7/02
(52) U.S. Cl. ..... 62/50.1; 62/51.1
(58) Field of Search ..... 62/50.1, 51.1, 62/51.2

(56) References Cited

U.S. PATENT DOCUMENTS 3,257,823 A * 6/1966 Hogan ..... 62/51.2
4,278,090 A * 7/1981 Van Gerven ..... 62/51.2
4,870,830 A * 10/1989 Hohenwarter et al. ..... 62/51.1
6,003,321 A 12/1999 Pinkerton et al.

* cited by examiner

*Primary Examiner*—Ronald Capossela
(74) *Attorney, Agent, or Firm*—Sughrue Mion, PLLC

(57) ABSTRACT

An open flow cryostat for cooling a sample in use comprises a supply (1) for supplying a coolant, an outlet (2) for directing a flow of the coolant towards the sample, a supply line (3) for transporting coolant from the supply to the outlet and an isolation line (5) arranged to transport at least some of the coolant away from the outlet. The isolation line (5) is positioned in contact with at least a portion of the supply line (3) to thermally isolate the supply line (3) from the surroundings.

12 Claims, 2 Drawing Sheets

CRYOSTAT

The present invention relates to an open flow cryostat for cooling a sample in use.

BACKGROUND OF THE INVENTION

Open flow cryostats are provided for directing a flow of a cryogen, such as helium, over a sample causing the sample to be cooled. This is typically used for cooling crystals to allow the crystal to be examined using X-ray diffraction, neutron diffraction, or other similar techniques.

However, such apparatus suffers from the drawback that large quantities of cryogen must be vented into the atmosphere in order to cool the sample. This coupled with a loss in efficiency caused by warming of the cryogen during transport from a supply vessel to the sample means that open flow cryostats tend to require large volumes of cryogen in order to operate.

In addition to this, problems can occur with ice formation on the sample crystal. A method of avoiding this problem is proposed in U.S. Pat. No. 6,003,321. This document describes a cryostat system which provides a primary helium flow over a sample crystal to cause the crystal to be cooled. In addition to this, a secondary helium flow is provided radially outwardly from the primary helium flow at a slightly warmer temperature. The secondary helium flow tends to help prevent the formation of ice on the sample crystal.

However, in this particular technique, this further increases the amount of helium required to operate the cryostat, thus making operation of this form of open flow cryostat extremely expensive.

SUMMARY OF THE INVENTION

In accordance with a first aspect of the present invention, we provide an open flow cryostat for cooling a sample in use, the cryostat comprising:

a. A supply for supplying a coolant;
b. An outlet for directing a flow of the coolant towards the sample;
c. A supply line for transporting coolant from the supply to the outlet; and,
d. An isolation line arranged to transport at least some of the coolant away from the outlet, the isolation line being positioned in contact with at least a portion of the supply line to thermally isolate the supply line from the surroundings.

Accordingly, the present invention provides an open flow cryostat for cooling a sample. The cryostat includes a supply line for transporting coolant from a supply to an outlet, and an isolation line arranged to transport at least some of the coolant away from the outlet. The isolation line is positioned in contact with a portion of the supply line so that the redirected coolant flowing in the isolation line will act to thermally isolate the supply line from the surrounding environment. This helps reduce the heating of the coolant within the supply line which is caused by the higher temperature of the surroundings, thereby improving the efficiency of the cryostat.

The isolation line is preferably arranged coaxially with and radially outwardly from the supply line. This ensures that the entirety of the supply line is thermally isolated from the surroundings. However, other configurations, such as spiraling the isolation line around the supply line could also be used.

A dewar is optionally positioned between the supply line and the isolation line for at least some of the supply line length. This helps provide further thermal isolation of the supply line from the surrounding environment, thereby reducing the heating effect of the surroundings on the coolant as it is transferred to the outlet.

Typically the cryostat further comprises a second supply for supplying a shielding coolant to the outlet, the outlet being adapted to direct a flow of the shielding coolant around at least a part of the coolant flow. The presence of the additional shielding coolant helps reduce the effect of the surroundings on both the stability and temperature of the main coolant flow.

The shielding coolant flow is preferably provided coaxially with and radially outwardly from the coolant flow as this is the most effective method of shielding the coolant flow from the surrounding environment.

Typically the second supply comprises a coolant store coupled to the isolation line thereby allowing coolant from the isolation line to be used as the shielding coolant. Thus, this advantageously reuses the coolant flowing back along the isolation line so that it can be used to provide the shielding coolant thereby helping to further reduce the amount of coolant required to operate the cryostat. The coolant store operates to store coolant temporarily prior to transfer to the outlet to provide the shielding flow, although this is not essential to the present invention.

Typically the shielding coolant has a higher temperature than the coolant as this also helps prevent the formation of ice on the sample.

The cryostat usually further comprises a gas supply coupled to the outlet, the outlet being adapted to generate a flow of gas and at least part of the coolant flow. This helps further protect both the shielding coolant flow and the coolant flow from the effects of the surrounding environment. Again, the gas flow is preferably arranged coaxially with and radially outwardly from both the shielding coolant flow and the coolant flow.

The isolation line is usually coupled to the supply via a pump, the pump being used to maintain pressure in the supply. This allows the pressure in the supply to be maintained by recirculating coolant thereby helping improve the efficiency of the system.

The supply usually comprises a dewar vessel for storing the coolant although any suitable store can be used.

The coolant is usually liquid helium as this is ideally suited for cooling the sample to the desired temperatures for carrying out X-ray diffraction, neutron diffraction or other similar procedures. However, the system can be used with any suitable cryogen, such as liquid nitrogen, liquid hydrogen, or the like, depending on the circumstances in which it is used.

BRIEF DESCRIPTION OF THE DRAWINGS

An example of the present invention will now be described with reference to the accompanying drawings, in which:

FIG. 1 shows an open flow cryostat according to the present invention. The cryostat includes a helium filled dewar vessel 1 coupled to an outlet nozzle, shown generally at 2, via a supply line 3. As shown, the outlet nozzle 2 includes at least a main nozzle 2A and a shielding nozzle 2B, as will be described in more detail with respect to FIG. 2. Coupled to the supply line 3 in the region of the outlet nozzle 2 is a isolation line 5. The isolation line 5 is arranged coaxially with and radially outwardly from the supply line 3 so as to surround the outer surface of the supply line 3.

Figure 1:
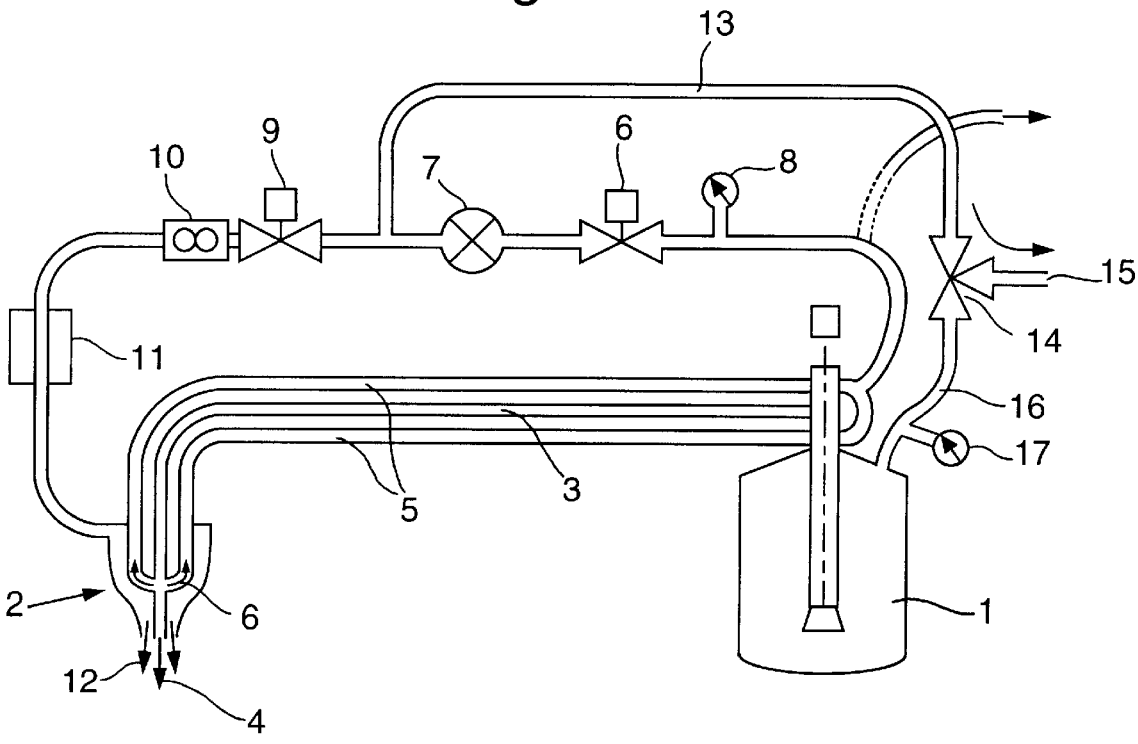
FIG. 1 is a schematic diagram of an open flow cryostat according to the present invention.

In use, the helium from the vessel can be transferred via the supply line 3 to the outlet nozzle 2 to generate a primary helium flow as shown at 4. At least some of the helium flowing along the supply line 3 is redirected as shown at 6 to flow back along the isolation line 5 towards the helium vessel 1. Accordingly, this creates a flow of helium in the isolation line 5 which operates to thermally insulate the supply line 3 from the surroundings.

DETAILED DESCRIPTION OF PREFERRED EMBODIMENTS

The isolation line 5 is coupled via a needle valve 6 to a pump 7. The pump 7 and the needle valve 6 cooperate to generate an under-pressure in the isolation line 5 to facilitate the transfer of helium from the supply line 3. A pressure meter 8 is provided to allow the pressure in the isolation line 5 to be monitored.

The output of the pump 7 is connected via a needle valve 9, a rotameter 10 to a helium store 11, such as a 2 litre capacity storage vessel. The output of the helium store is then coupled to the shielding nozzle 2B of the outlet nozzle 2 to generate a shielding helium flow, as shown generally at 12. The strength of the shielding flow can be adjusted by using the needle valve 9 and the rotameter 10 to control the rate of flow of helium into the helium store.

The output of the pump 7 is also coupled via a transfer line 13 to a dual way valve 14. The dual way valve allows helium to be vented to the atmosphere via an outlet 15. In addition to this, the dual way valve 14 allows helium to be partially transferred back to the helium filled dewar vessel 1 via a transfer line 16 to build up and maintain the pressure inside the dewar vessel 1. A pressure meter 17 is generally provided on the transfer line 16 allowing the pressure of helium inside the dewar vessel 1 to be monitored.

The dual way valve also allows the dewar vessel 1 to be pressurized from an external source when the apparatus is initially configured.

Figure 2:
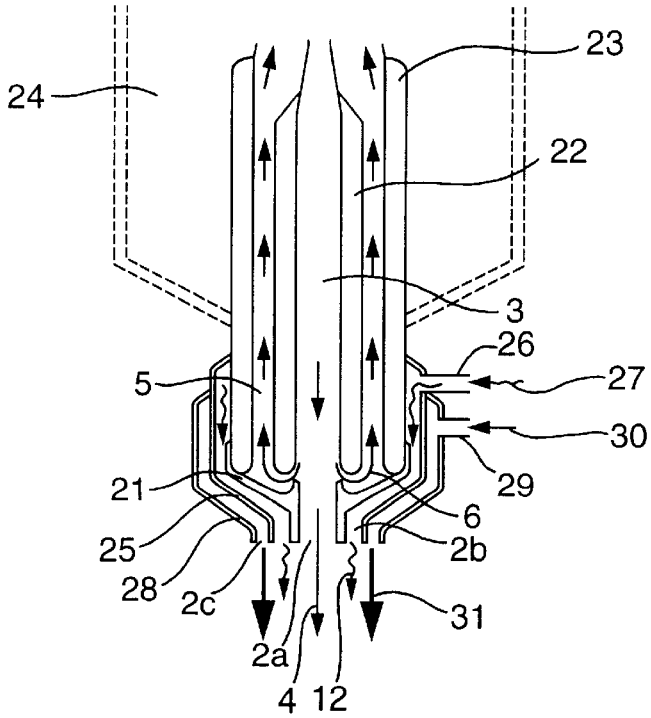
FIG. 2 is a close-up of the outlet nozzle of the cryostat of FIG. 1; and, FIGS. 3A and 3B are graphs showing the temperature distribution in the region of the outlet nozzle of the apparatus of FIG. 1.

A more detailed view of the outlet nozzle 2 is shown in FIG. 2.

As shown in FIG. 2, the nozzle includes a deflecting shield 21 positioned by the end of the supply line 3. The deflecting shield 21 is shaped to cause some of the helium flowing along the supply line 3 to be deflected back up the isolation line 5 as shown by the arrows 6. The deflecting shield is also shaped so as to define the main nozzle 2A thereby generating the main flow of helium gas 4.

Positioned between the supply line 3 and the isolation line 5 is an inner dewar 22 which operates to provide thermal isolation between the supply line 3 and the isolation line 5. Further insulation from the external environment is provided by an outer dewar 23 and by a vacuum environment 24 provided around the outside of the outer dewar 23, as shown. The inner and outer dewars 22,23 are generally only provided near the outlet nozzle 2 and do not run along the entire lengths of the supply and isolation lines 3,5. However, the whole of the supply and isolation lines 3,5 are isolated from the surroundings by the vacuum environment 24.

The shielding nozzle 2B, which is positioned radially outwardly from the main nozzle 2A is formed from a shield housing 25 positioned as shown around the deflecting shield 21. In use, the shield housing 25 is coupled to the helium capacitor 11 via an input 26, thereby allowing helium to enter the housing 25 as shown by the arrows 27. The helium then exits the outlet nozzle 2 via the shielding nozzle 2B to generate a shielding flow coaxially and radially outwardly from the main helium flow 4, as shown by the arrows 12.

A further gas housing 28 is positioned over the shield housing 25 to define a gas flow nozzle 2C. In use, a dry gas, such as air or dried nitrogen is pumped into the gas housing 28 via an inlet 29, as shown by the arrow 30. The dry gas then exits the housing 28 via the gas nozzle 2C to generate a shielding flow of gas. This shielding gas flow is much heavier than the helium and which therefore creates an inertia curtain separating both the helium streams from environmental turbulences, as shown by the arrows 31.

Accordingly, in use helium is transferred from the helium vessel 1 via the supply line 3 to the outlet 2. The majority of this helium flows out of the main nozzle 2A to generate the primary helium flow 4. At least some of the helium from the supply line is redirected by the deflecting shield 21 into the isolation line 5.

This redirected helium flows to the pump 7 via the needle valve 6 and the isolation line 5 thereby insulating the supply line 3 from the surroundings.

Helium from the isolation line can then be directed via the needle valve 9, the rotameter 10 and the helium capacitor 11 into the shield housing 25 to generate a shielding helium flow 12. As mentioned above, the strength of this shielding flow is controlled by adjusting the amount of helium entering the helium capacitor using the rotameter 10 and the needle valve 9.

Alternatively, the helium can be transferred via the transfer line 13 and the dual way valve 14 to either the outlet 15 and hence the atmosphere, via the transfer line 16 to the dewar vessel 1.

In use, during a start-up procedure, the main nozzle 2A is blocked by a shutter (not shown). Accordingly, all the helium transferred via the supply line 3 is recirculated via the isolation line 5. This operates to cool the apparatus down to an operating temperature without wasting helium by venting the helium to the atmosphere via the main nozzle 2A.

Once the system has reached operating temperature, the shutter can be open allowing the main helium flow 4 to be established.

Under normal operating procedures, as described above, the helium transferred back via the isolation line is used to generate the shielding flow 12 and simultaneously partially build up and maintain the pressure inside the dewar vessel 1.

Thus, the pump 7 is used to control the pressure of the helium inside the dewar vessel 1, to ensure that the main dewar vessel remains pressurized at all times. In addition to this, the combination of the pump 7 and the needle valve 6 also operate to create under-pressure in the isolation line thereby facilitating the transfer of helium from the supply line 3 back along the isolation line 5.

The result of operation in this manner is that a very uniform temperature distribution is produced across and along the main helium flow 4. An example plot of the temperature distribution along the main helium flow 4 is shown in FIG. 3A with an example of the temperature profile across the main helium flow being shown in FIG. 3B.

Figure 3A:
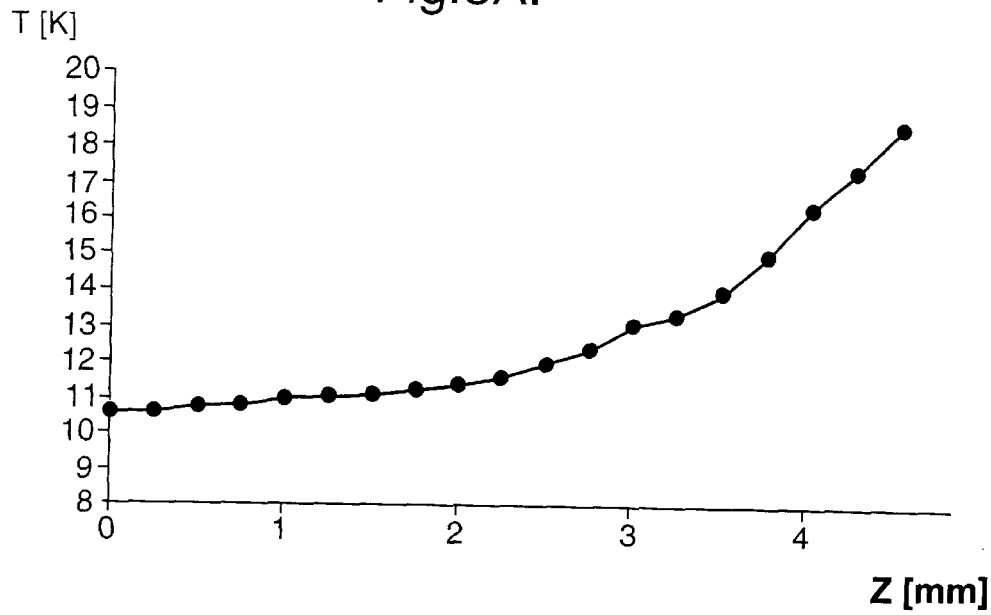
Figure 3B:
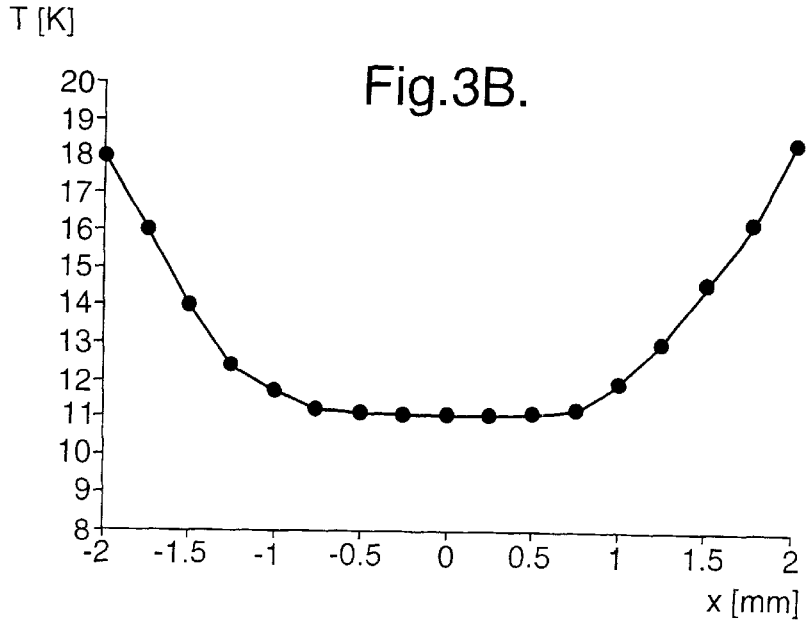

FIG. 3A shows the temperature profile as it varies with distance "Z" from the tip of the main nozzle 2A in the direction of the gas flow. In FIG. 3B, the temperature distribution is measured with distance "X" from the center of the main nozzle 2A radially outwardly, perpendicular to the direction of flow of the main helium flow 4.

As shown the temperature of the helium flow is symmetrical and stable, as well as remaining cool a significant distance from the main nozzle 2A. As a result of this improved temperature distribution, the sample can be cooled as required without requiring shielding around the sample thereby allowing various measurements to be made on the sample.

In addition to this, the recirculation of the helium results in a helium consumption not exceeding 2.51/h for maintaining a sample at 10 K. Similarly, for a sample temperature of 15 K the helium consumption is typically 21/h, whereas for a temperature of several dozen K the consumption is approximately 1.51/h.

What is claimed is:

1. An open flow cryostat for cooling a sample in use, the cryostat comprising:

a. A supply for supplying a coolant;

b. An outlet for directing a flow of the coolant towards the sample;

c. A supply line for transporting coolant from the supply to the outlet; and, d. An isolation line arranged to transport some of the coolant away from the outlet, the isolation line being positioned in contact with at least a portion of the supply line to thermally isolate the supply line from the surroundings.

2. A cryostat according to claim 1, wherein the isolation line is arranged coaxially with, and radially outwardly from the supply line.

3. A cryostat according to claim 2, wherein a dewar is positioned between the supply line and the isolation line.

4. A cryostat according to claim 1, the cryostat further comprising a second supply for supplying a shielding coolant to the outlet, the outlet being adapted to direct a flow of the shielding coolant around at least a part of the coolant flow.

5. A cryostat according to claim 4, wherein the shielding coolant flow is provided coaxially with and radially outwardly from the coolant flow.

6. A cryostat according to claim 4, wherein the second supply comprises a coolant capacitor coupled to the isolation line thereby allowing the coolant from the isolation line to be used as the shielding coolant.

7. A cryostat according to claim 6, wherein the shielding coolant has a higher temperature than the coolant.

8. A cryostat according to claim 1, the cryostat further comprising a gas supply coupled to the outlet, the outlet being adapted to generate a flow of gas around at least part of the coolant flow.

9. A cryostat according to claim 1, the cryostat further comprising a second supply for supplying a shielding coolant to the outlet, the outlet being adapted to direct a flow of the shielding coolant around at least a part of the coolant flow, and the cryostat further comprising a gas supply coupled to the outlet, the outlet being adapted to generate a flow of gas around at least part of the coolant flow, wherein the gas flow is arranged coaxially with and radially outwardly from the shielding coolant flow.

10. A cryostat according to claim 1, wherein the isolation line is coupled to the supply via a pump, the pump being used to maintain pressure in the isolation line, thereby aiding the flow of coolant from the outlet to the supply.

11. A cryostat according to claim 1, wherein the supply comprises a dewar vessel for storing the coolant.

12. A cryostat according to claim 1, wherein the coolant is liquid helium.

* * * * *